US011047217B2

(12) United States Patent
Orsini

(10) Patent No.: US 11,047,217 B2
(45) Date of Patent: Jun. 29, 2021

(54) SAFETY VALVE

(71) Applicant: FORE S.r.l, Spoltore (IT)

(72) Inventor: Paolo Orsini, Spoltore (IT)

(73) Assignee: FORE S.R.L., Spoltore (IT)

( * ) Notice: Subject to any disclaimer, the term of this patent is extended or adjusted under 35 U.S.C. 154(b) by 28 days.

(21) Appl. No.: 16/495,284

(22) PCT Filed: Mar. 21, 2018

(86) PCT No.: PCT/IB2018/051885
§ 371 (c)(1),
(2) Date: Sep. 18, 2019

(87) PCT Pub. No.: WO2018/172946
PCT Pub. Date: Sep. 27, 2018

(65) Prior Publication Data

US 2020/0032628 A1 Jan. 30, 2020

(30) Foreign Application Priority Data

Mar. 22, 2017 (IT) ..... 102017000031592

(51) Int. Cl.

| | |
|---|---|
| ***E21B 43/12*** | (2006.01) |
| ***E21B 4/00*** | (2006.01) |
| ***E21B 34/14*** | (2006.01) |
| ***E21B 34/16*** | (2006.01) |
| ***E21B 34/10*** | (2006.01) |

(52) U.S. Cl.
CPC ..... *E21B 43/126* (2013.01); *E21B 4/003* (2013.01); *E21B 34/14* (2013.01); *E21B 34/16* (2013.01); *E21B 34/10* (2013.01)

(58) Field of Classification Search
CPC ..... E21B 43/126; E21B 34/14; E21B 34/16; E21B 34/10; E21B 2200/01; E21B 43/121; E21B 23/01
See application file for complete search history.

(56) References Cited

U.S. PATENT DOCUMENTS

| | | | | |
|---|---|---|---|---|
| 2,131,822 | A | 10/1938 | Schmidt | |
| 9,605,504 | B2 * | 3/2017 | Leuchtenberg | E21B 33/06 |
| 9,638,330 | B2 * | 5/2017 | Itou | F04B 53/02 |
| 2009/0056948 | A1 | 3/2009 | Martin et al. | |
| 2011/0037231 | A1 | 2/2011 | Murray | |
| 2012/0312548 | A1 * | 12/2012 | Swist | E21B 21/10 166/373 |

FOREIGN PATENT DOCUMENTS

| | | | |
|---|---|---|---|
| CN | 203161152 U | * | 8/2013 |
| CN | 203161152 U | | 8/2013 |
| CN | 104847306 A | * | 5/2015 |
| CN | 104847306 A | | 8/2015 |
| EP | 3121447 A1 | | 1/2017 |

OTHER PUBLICATIONS

ISR & WO issued in Application No. PCT/IB2018/051885 dated Jun. 11, 2018, 66 pages.

* cited by examiner

*Primary Examiner* — D. Andrews
*Assistant Examiner* — Jonathan Malikasim
(74) *Attorney, Agent, or Firm* — Arent Fox, LLP

(57) ABSTRACT

An extraction systems in the oil sector, in particular to the equipment intended for the completion of the wells after their drilling; more in particular, the system relates to a safety valve for artificial lifting wells driven by reciprocating downhole rod pumps.

9 Claims, 3 Drawing Sheets

SAFETY VALVE

CROSS-REFERENCE TO RELATED APPLICATION

This application is a 35 U.S.C. § 371 National Phase Application of PCT Application No. PCT/IB2018/051885 filed Mar. 21, 2018, entitled "SAFETY VALVE," which claims priority to Italian Application No. 102017000031592, filed Mar. 22, 2017, entitled "SAFETY VALVE," the disclosure of the priority application is incorporated in its entirety herein by reference.

TECHNICAL FIELD OF THE INVENTION

The present invention refers to extraction systems in the oil and gas field, in particular to well completion equipment.

The present invention, particularly refers, to a downhole safety valve for sucker rod pump completions

BACKGROUND

In the oil and gas field, the term completion refers to one of the upstream activities aimed to equip the well, with all the necessary equipment to flow the hydrocarbons to the surface, in spontaneous flow or artificial lift.

The completion activity takes place after the drilling activity, which includes running a casing into the well and cementing the same.

Within this activity, one of the minimum safety criteria used to design the well, imposes the use of a failsafe downhole safety valve to install below the ground level, in order to provide an emergency safety barrier to flow, in case of uncontrolled blow out due to an incident damaging the wellhead.

In general, the opening and the closing of said downhole safety valve is controlled by the surface system by a control line, where the control fluid pressure keeps the valve open and, in case the pressure, in the control line fails, the safety valve closes preventing any extraction fluid to come to the surface.

Moreover, the downhole safety valves can be classified based on their installation/retrieving method and their shutting mechanism.

In particular, one first typology (TRSCSSV) is integral to the well completion, it is installed and retrieved with the tubing string.

A different typology (WRSCSSV) the insert type instead, can be installed and retrieved without operations on the well completion tubing, but, through a well service intervention (slick line, coil tubing, snubbing unit or sucker rod) which allows to install or retrieve to/from a relevant seat using a suitable tool.

For both afore mentioned downhole safety valves the conventional shutting systems are spheres or hinged flappers.

It is known from the patent request US 2009/0056948 and US 2011/0037231 the use of downhole safety valves in artificial lift systems, where artificial lift is done through volumetric pumps, in particular with rotating or reciprocating sucker rods. US 2009/0056948 discloses a downhole safety valve with a sealing system on the sucker rods, but, it has the disadvantage to have a tortuous flow path for the extraction of fluid, therefore, can be easily clogged with debris or paraffin.

US 2011/0037231 discloses a downhole safety valve with a sealing system which is always engaged on the sucker rod, exposing the safety valve to some limitations. In particular due to the small flow path between the sealing system and the sucker rod, when the seal is not in the sealing mode, it does not guarantee an optimal and economic hydrocarbon flow rate. Furthermore, the sealing system of this valve is exposed to important wearing, because it is always in contact with the sucker rod.

CN 104847306 discloses an underground rod pipe safety valve used for rod driving artificial lifting, wherein spherical rubber core sealing assembly is pushed to move along a spherical inner wall of an upper part of the valve body, so that an annular passage formed between a sucker rod and an oil pipe is closed or opened.

EP 3121447 discloses an ultrahigh-pressure sealing device and a reciprocating pump that improve sealing performance under ultrahigh pressures.

A sealing device for a sucker rod is disclosed for example by CN 203161152. Said sealing device is capable of sealing an annulus of a pipe rod, so as to overcome the inflexible switch and the tight sealing of the annulus of the pipe rod.

A double acting well pump is disclosed by U.S. Pat. No. 2,131,822.

BRIEF DESCRIPTION OF THE INVENTION

The scope of the present invention therefore is to overcome the aforementioned problems, which is obtained through a downhole safety as defined on claim 1.

In particular, it is scope of the present invention to present a safety valve for reciprocating downhole sucker rod pumps which, when installed and in open position, compared to aforementioned safety valves, improves the flow path and outflow capability during the hydrocarbon extraction.

It is also scope of the present invention to present a safety valve, which allows to minimize the maintenance related to their sealing system.

Further characteristics of the present invention, are defined in the corresponding dependent claims.

The present invention refers to a downhole safety valve for hydrocarbon extraction wells, completed in artificial lift with downhole sucker rod pumps.

The valve comprises a main body, a sealing system and devices for its actuation.

The main body is internally hollow, and it is configured to allow the sliding movement of a sucker rod therein. The sealing system, which includes a plurality of elastic and reversible elements arranged to surround said rod, is connected on its internal wall.

The actuating means is connected to the sealing system and they are configured to drive the motion of the reversible elastic elements.

Specifically, the hollow of the main body is provided with a conical section region apt to cooperate with the sealing system in such a way that the plurality of the reversible elastic elements is movable between a first operating condition (open) in which the fluid stream crosses the valve, in a defined flow path between the sealing system and the rod. In the second operating position in which each of the elastic reversible elements contact the sucker rod occupying the flow path and shut in the same, preventing any flow across the valve.

Each reversible elastic element further comprises a free end provided with a sealing pad having an impact surface lying on a plane orthogonal to an extraction direction of the fluid.

This solution allows to have a downhole safety valve which does not limit the stroke of the sucker rod's reciprocating motion.

Moreover, the plurality of the sealing elements in the first operating condition (open) is not in contact with the sucker rod during its reciprocating motion.

In this way, the wear of the sealing elements is minimized because the friction between the seals and the sucker rod occurs with the safety valve in the second operation position only, when there is no motion on the sucker rod.

Advantageously, providing impact surfaces on the reversible elastic elements confers to the valve the capability of a self-sealing action which ensures its maintenance in the closed condition even in case, for example, of failure of the actuating means. By means of such specific configuration of the sealing system, the greater is the pressure exerted by the extraction fluid, the greater is the sealing that the valve offers in the closed condition.

Advantageously, the preferred embodiment of the present invention provide that the safety valve sealing system comprises a tubular collet collar, coaxial to the main body, equipped with a segmented section in eight reversible elastic elements.

Said solution defines the extraction fluid route through the safety valve in open conditions with an annular flow path without tortuosity, limiting in fact possible obstruction due to debris sediments and easily allowing economic flow rates in line with the design conditions.

Other advantages, together with the characteristics and other use mode of the present invention, will be evident from the following detailed description of its favorite embodiments, presented as illustrative and not limitative.

BRIEF DESCRIPTION OF THE FIGURES

The drawings shown in the enclosed figures will be referred to, wherein.

DETAILED DESCRIPTION OF PREFERRED EMBODIMENTS

The present invention will be hereafter described referring to the aforementioned figures.

Figure 1:
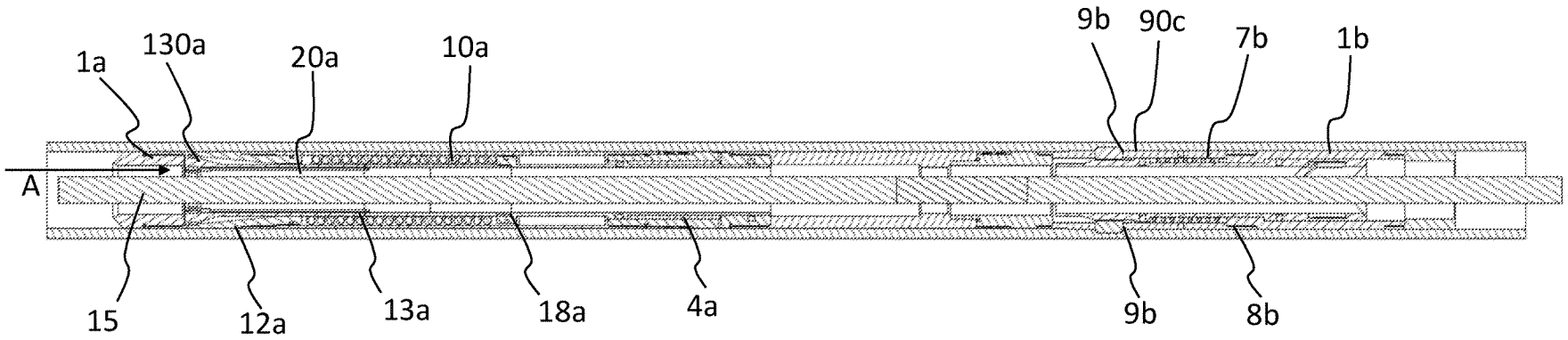
FIG. 1 shows an overview in lateral cross sectional of a preferred embodiment of a safety valve according to the present invention made up on a locking system, in a first operating condition.
Figure 2:
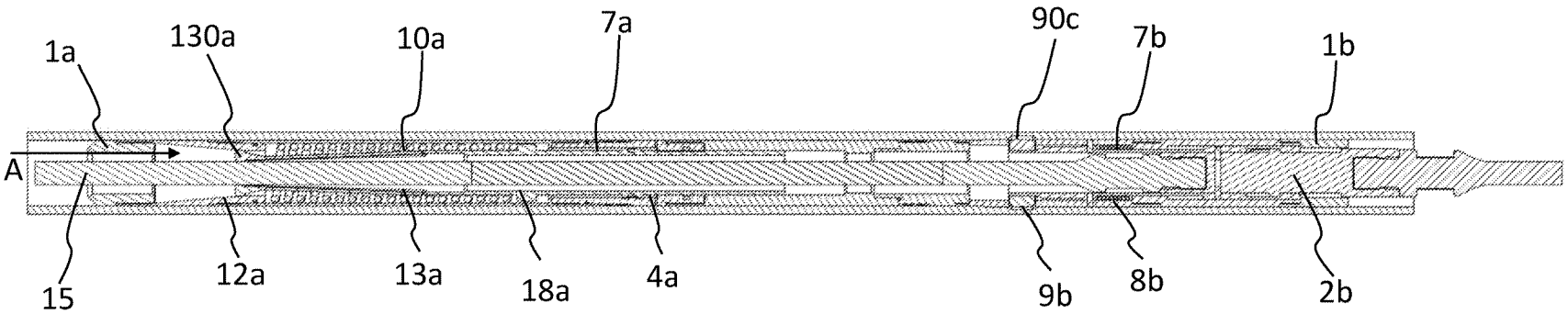
FIG. 2 shows an overview in lateral cross section of the safety valve made up on the locking system shown in FIG. 1, in a second operating condition.

With initial reference to the FIGS. 1 and 2, is shown a valve 1*a* according to the present invention.

In general terms, the valve 1*a* is a downhole safety valve, and can be installed inside wells intended for extraction activity, in particular of hydrocarbons.

The safety valve 1*a* is intended to be inserted in well completions which foresees artificial lift with downhole sucker rod pumps. In particular the safety valve 1*a* can have two main application typologies.

A first typology provides that the downhole safety valve 1*a* is installed and retrieved in integral mode with the well completion.

A second typology of application provides that the downhole safety valve 1*a* is "insert type" in other words can be installed and retrieved via Well service (slick line, coil tubing, sucker rods). The "insert type" wire line retrievable, (slick line, coil tubing or sucker rods) is installed into a conventional seat for valves, or inside a conventional integral valve upon completion of the well, after it has been locked in the opening position and the hydraulic control line has been qualified for the insert safety valve.

In both cases, related to the second type, the installation and the recovery, can be performed by the sucker rods string.

Moreover, the safety valve 1*a*, in case it is an insert type, provides for a locking mechanism 1*b*, which is mounted at one end, thus making up the mechanical interface of the valve housing profile.

In this way, it is possible to anchor the valve inside the well and hold the force generated across the valve 1*a* once it closes.

In this second type of application, moreover, the assembly including the safety valve 1*a* and the locking mechanism 1*b* is mounted and locked, using safety pins, on and running tool 2*b*.

This running tool 2*b* is an integral part of the rod string used to run the safety valve in the well during the installation. The valve 1 is preferably made of low carbon steel with minimum yield strength of 550-560 newton/mm$^2$ and the sealing units should be preferably made of elastomers.

For applications in corrosive environments, it is necessary to build the valve according to the indications for the related metallurgies.

In general terms, the operating principle that resides at the base of the safety valve will be described below is as follows.

Once installed, and during the pumping operations in the well, the safety valve 1*a* surrounds a section of the string of sucker rods and allows the passage of the extraction fluid, kept open by the pressure present inside the control circuit, in which is present a control fluid.

The control circuit is preferably hydraulic and the pressure applied by the fluid pushes a piston towards the bottom of the well. This piston is connected to a sealing system, and the pushing on the piston maintains the sealing system in a rest position.

In particular, the piston, with the pressure present in the control circuit, actuates and compresses an elastic element—in the illustrated embodiments, a spring 10*a*.

The rest position of the sealing system is a position in which the extraction fluid can pass through the control valve 1*a* and flow to the surface.

When the pressure in the control line fails, for example due to failures or accidents, this condition is detected on the surface and the alternative pump which moves the rod 15 is stopped at its bottom dead center.

Due to the pressure drop in the control circuit, the elastic element overcomes the thrust force of the piston and the sealing system of the safety valve 1*a* rises towards the surface, until it contacts the sucker rod 15, sealing around it.

The sealing system is therefore in a closed position of the safety valve, preventing the extraction fluid from passing through the latter and rising towards the surface.

Any differential pressure acting from the bottom of the well on the sealing system, generates work on the latter which increases the holding force of the sealing system on rod 15.

Once the well's extraction operating conditions are restored, the safety valve 1*a* can be reopened, applying pressure to the control line, and eventually balancing the pressure across the system, as to compress the elastic element again, bringing the sealing system back to it's resting position. The pumping of the well can be resumed.

Figure 3:
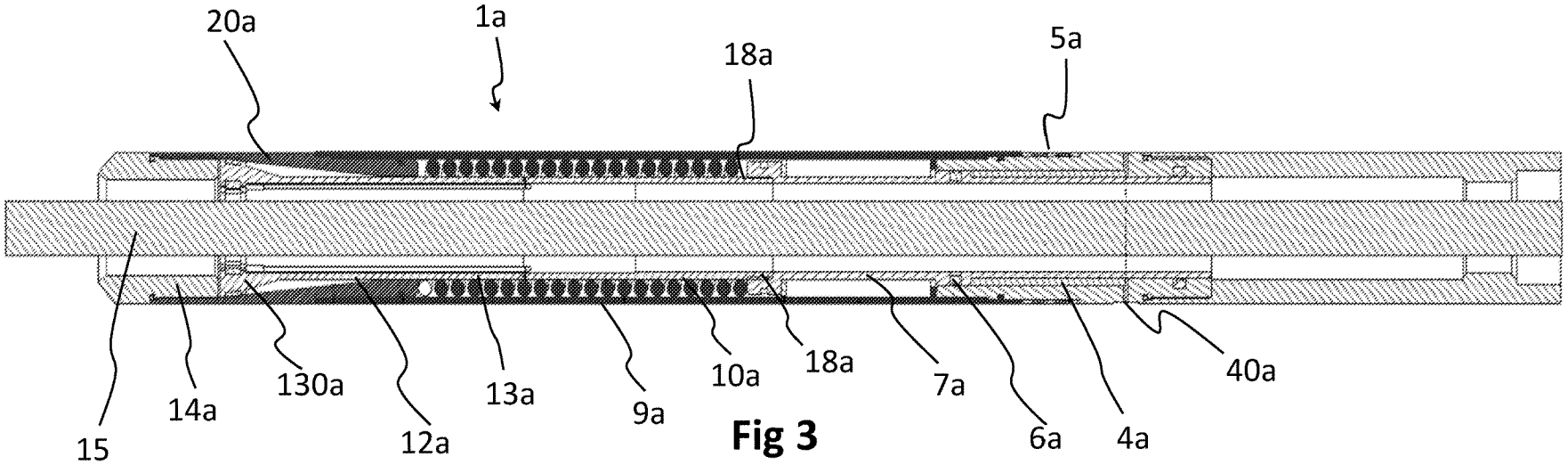
FIG. 3 shows an overview of a magnified view in lateral cross section of the safety valve only, shown in FIG. 1 in the first operating condition.
Figure 4:
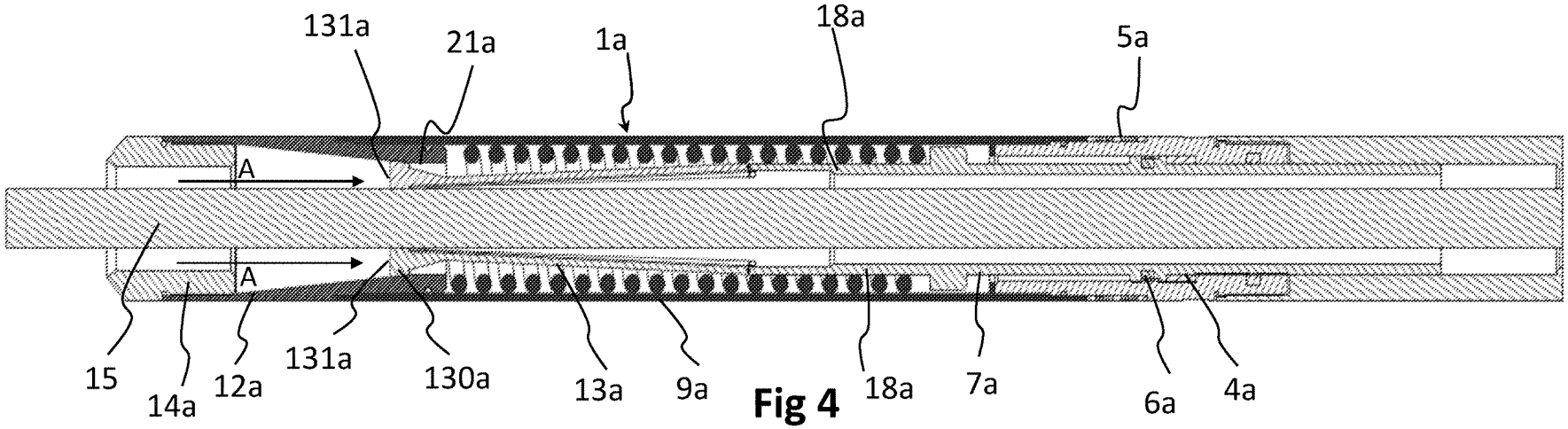
FIG. 4 shows an overview of a magnified view in lateral cross section of the safety valve only, shown in FIG. 1 in the second operating condition.

As better shown in FIGS. 3 and 4, the valve therefore is made of a main body 9, which is internally hollow and is shaped in such a way to allow the sliding of rod 15 internally.

The valve 1*a* further includes the sealing system connected to the inner wall of the main body 9*a*, the sealing system includes a plurality of reversible elastic elements 13*a* arranged to surround said rod 15.

Furthermore, actuating means of the valve, are connected to the sealing system and configured to allow movement of the reversible elastic elements 13*a*.

As shown, the cavity of the main body 9*a* is equipped with a conical section region 12*a*, able to cooperate with the sealing system, such a way that the plurality of reversible elastic elements 13*a*, are movable between a first operating condition in which the fluid passes through the valve 1*a*, in a flow path area 20*a* defined between the sealing system and the rod 15, and a second operating position in which each of the reversible elastic elements 13*a* contact the rod 15 and occupy said flow path area 20*a*, preventing the passage of the fluid through the valve 1*a*.

Preferably, the sealing system includes a tubular collar 18*a* coaxial to the main body 9*a* in which the flow path area is a circular ring, and wherein the tubular collar 18*a* is equipped with a portion segmented into eight reversible elastic elements 13*a*.

More in detail, and with reference to the embodiment shown in FIGS. 3 and 4, each reversible elastic element 13*a* comprises a free end provided with a seal pad 130*a* with a substantial tapered section.

This section is preferably shaped to slide on the conical section region 12*a*, of the main body 9*a*, and in the case where the sealing system is in said second operating position, each sealing pad 130*a* contacts the rod 15 and the conical section region 12*a* with their flanks, so that the flow path area 20*a* of the valve 1*a* is entirely occupied by the set of seal pads 130*a*.

Moreover, preferably, the actuation means are of hydraulic type and include an internal mandrel or piston 7*a* a chamber 4*a* and a spring 10*a*.

The main body 9*a* has an opening 40*a* in communication with the chamber 4*a* in order to allow the connection of the actuation means with a control circuit of the valve 1*a*.

During the closing of the valve 1, the spring 10*a* pushes the plurality of reversible elastic elements 13*a* along the conical region 12*a* of the main body 9*a*, so that the sealing pads 130*a* rising inside the cone seal around the pumping rod 15.

Preferably, the seal pads 130*a* are shaped to close, in this case, simultaneously on a pumping rod of 1" (25.4 mm) and on the sides of the main body 9*a* such a way to create a sealing system.

Although the present description refers to a preferred sealing system embodiment, i.e. equipped with eight reversible elastic elements, the number considered in this example is to be understood to be not limiting for the present invention.

The sealing system can in fact foresee a number of reversible elastic elements greater or less than eight, for instance as a function of different diameters of the pumping rods or the valve nominal size.

Moreover, advantageously, according to the present invention, the maximum stroke of the pump is dictated by the length of the pumping rod working inside the valve 1*a*.

For example, with a pumping rod 9 meters long, any closure of the valve 1*a* would close and seal on the rod body passing through it, ensuring the barrier to flow to the pressurized fluids below the valve itself.

The seal pads 130*a*, which furthermore can be vulcanized with rubber in their inner part and on the sides, mates to each other and provide a seal at 360° degrees around the pumping rod 15, such a way to ensure a positive upward seal against the conical region 12*a* of the main body 9*a*.

Moreover, the pressure applied by the extraction fluid below the seal pads 130*a*, in the condition of closed valve 1*a*, helps to keep the valve in the closed position.

As can be appreciated in FIGS. 1-4, each sealing pad 130*a* comprises an impact surface 131*a* shaped in such a way as to provide to the fluid flow, according to a resulting extraction direction identified with the arrow reference A, an opposing element to its advancement through the valve 1*a* towards the surface of the well.

The resulting extraction direction is a direction which further defines a flow stream orientation across the valve 1*a*, wherein upstream of valve the fluid is at a higher pressure than at downstream of the valve.

While closing of the valve, due to the sliding along the conical region 12*a* of each sealing pad 130*a*, the impact surface 131*a* exposed to the fluid flow increases, progressively narrowing the section of the outflow area 20*a* until it is completely occupied.

With reference to FIG. 4, said impact surface 131*a* lies substantially on a plane orthogonal to the resulting extraction direction and the set of all impact surfaces 131*a* of each sealing pad 130*a*, in closed valve condition, realizes a circular crown which completely surrounds the pumping rod 15.

As shown, the conical region 12*a* is shaped as to determine at least one section 21*a* of the outflow region 20*a* with a minimum diameter, wherein said minimum diameter is smaller than the inner diameter of said circular crown.

Synergistically to the actuation provided by the actuation means, the tubular collar 18*a*, through the pressure exerted by the fluid on said impact surfaces, is therefore further pushed, during its movement towards the closing condition and in particular in the closed valve condition, from the fluid itself that tries to cross the valve.

Providing impact surfaces on the reversible elastic elements 13*a* thus confers to the valve the capability of a self-sealing action which ensures its maintenance in the closed condition even in the case, for example, of a malfunction of the control circuit and/or of the actuation means associated with the latter.

In other words, the sealing system is not only favored by the wedge shape provided with the conical region 12*a* which cooperates with the flanks of the sealing pads 130*a*, but is advantageously assisted by the provision of impact surfaces 131*a* of the sealing pads themselves which, as the differential pressure increases between the upstream and the downstream of the valve, increase the sealing capability of the valve.

The greater is the pressure exerted by the extraction fluid, the greater is the sealing that the valve offers in the closed condition.

In this way, advantageously, the valve according to the present invention does not limit the stroke on a reciprocating motion rod pump, and the sealing system is not in contact with the rod during the pumping phase, i.e. in the first operating condition—that is, an open valve.

In preferred embodiments, an automatic control system can be installed on the well, on surface, to stop the pump when pressure on the control line is discharged voluntarily or due to system failure.

Preferably, the safety valve 1*a* can move into its closed position only when the pump rod stops and descends in a position close to that of the bottom dead center.

Furthermore, depending on the type of application of the valve 1*a*, in particular in case the valve is of the insert type, one end of the main body 9*a* of the valve 1*a*, can be connected to a locking system 1*b*, for the lock in the well of the valve itself, via, for example, an ACME threaded connection.

This locking system 1*b* will be described in more detail hereinafter with reference to FIGS. 5 and 6.

Going back to FIGS. 3 and 4, the chamber 4*a* of the actuation devices is a hydraulic chamber with a radial hole 40*a* for connection of the control fluid and is equipped with a lower sealing element, for capturing the fluid of the control line that, otherwise, would flow into the main body 9*a* of valve 1*a*.

The hydraulic chamber 4*a* can also accommodate an upper sealing element on an internal mandrel or piston 7*a* of the valve 1*a*.

It can contain a groove, worked with a grinded surface, to accept the lower seal of the hydraulic chamber and to capture and isolate the pressure coming from the control line and act on the differential area, capable to move the internal mandrel or piston 7*a* internal to the valve 1*a* and compress the spring 10*a*.

The body of the hydraulic chamber 4*a* can also be connected to the body of the valve 9*a* by means of an ACME connection, blocked by an appropriate restraining system.

The main body of the valve 9*a* can be extended to a length necessary to contain the spring 10*a* and can, in variant favorite embodiments, be uncoupled from the conical region 12*a* of the valve. In this case the coupling is an ACME connection, blocked by an appropriate restraint system.

The conical region 12*a* of the main body 9*a* of the valve can be connected to a terminal end 14*a* of the main body by means of an ACME connection blocked by an appropriate restraining system.

The internal mandrel or piston 7*a* of the valve 1*a* also defines a groove, which carries the seal 6*a* toward the body of the hydraulic chamber 4*a*.

The internal mandrel or piston 7*a* is provided with two shoulders, an upper one to stop the upward movement (when in contact with the shoulder of the hydraulic chamber body 4*a*), a lower one for the exchange of loads with the spring 10*a*.

When the hydraulic pressure is lost, the internal mandrel or piston 7*a* of the valve 1*a* and therefore the collar 18*a* can move in an upwards movement under the boost of the spring 10*a* which returns to its extended position.

The internal mandrel or piston 7*a* of the valve is preferably connected to the collar 18*a* by means of an ACME connection blocked by an appropriate restraining system.

As previously stated, the upper portion of the collar 18*a* is solid, while the lower part is milled longitudinally to obtain, in this case, eight elastic elements—or fingers—13*a*. Each finger carries at its end the sealing pad 130*a* with a trapezoidal conical section.

The sealing pads 130*a*, are segmented into slices, in particular into eight equal parts of a trapezoidal ring, where the surface facing the main body 9*a* of the valve 1*a* has the same inclination of the conical region 12*a* of this last one: the internal diameter of this ring can match with the external diameter of the pumping rod 15 and cannot be adapted to different rod diameters.

In fact, in order that the sealing system can close on rods of different diameters it is necessary to provide a collar 18*a* (and its reversible elastic elements) specific for the diameter of the rod used.

The geometry of the elastic elements of a collar allows the seal to be held on a single diameter value of the rod.

In the technological process of manufacturing the valve 1*a*, after the segmentation of the collar 18*a*, the sealing pads 130*a* can be vulcanized with the rubber both in their inner part to seal on the rod 15 both on their surfaces, radially cut, to seal to each other when they come into contact for the closing of the valve, in other words when they travel on the conical region 12*a*, raised by the fingers 13*a* of the collar 18*a* and pushed by the spring 10*a*.

Figure 5:
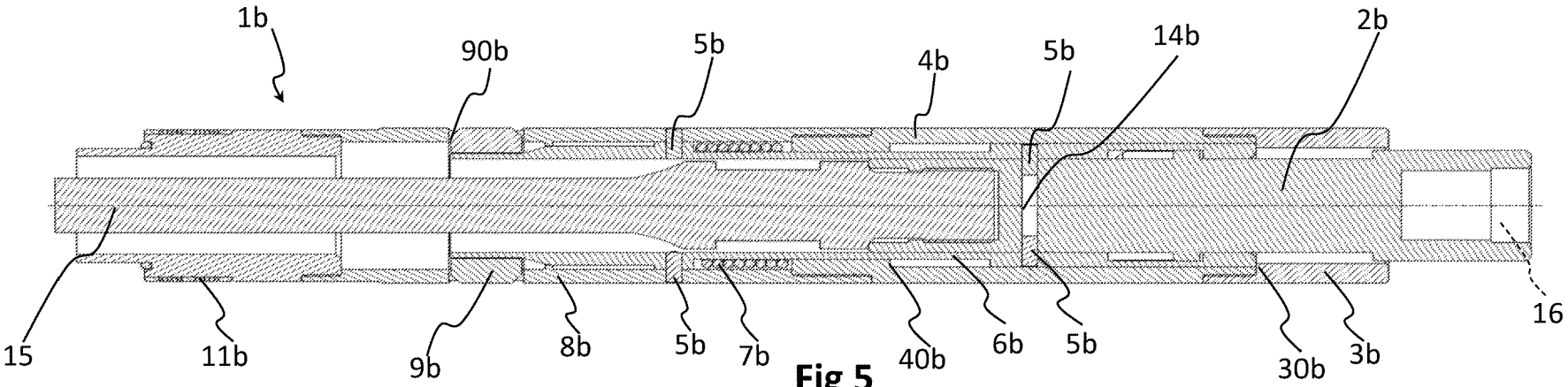
FIG. 5 shows an overview of a magnified view in lateral cross section of the lock system only, in unlock conditions.
Figure 6:
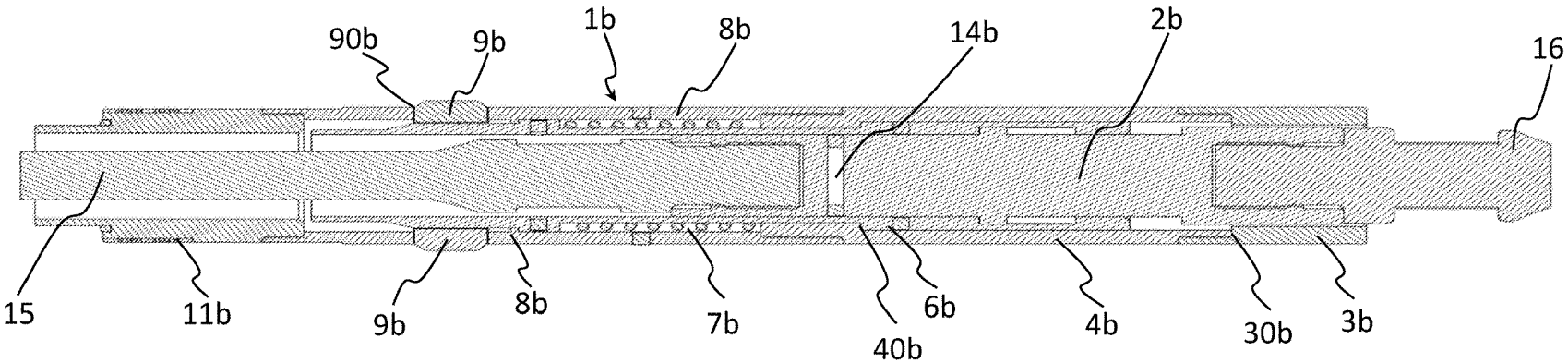
FIG. 6 shows an overview of a magnified view in lateral cross section of the lock system only, in lock condition.

With reference to FIGS. 5 and 6, now will be described the locking system 1*b* of the valve.

The locking system 1*b* is a mechanism, which allows to anchor the valve 1*a* in a recess inside the well.

This locking mechanism 1*b* is preferably applied to the version of insert safety valve, not being at first necessary for the application of the safety valve forming an integral part of the well completion.

The locking mechanism 1*b* of the valve 1*a* in well is configured to be mechanically connected to one end of the main body 9*a*, for example by means of an ACME threaded connection blocked by an appropriate restraining system.

It will be noted how this locking system 1*b* provides a mechanical bond of the valve towards its sealing seat inside the well, in order to retain the forces due to the differential pressure generated across the valve shutting system 1*a* in the condition of closure of it.

In general terms, the locking system 1*b* includes a hollow tubular element 8*b*, coaxial to the main body 9*a* and configured to allow the sliding of a rod 15 inside it.

Said system further includes a plurality of openings 90*b* obtained in the tubular element 8*b*, configured for housing means of interference 9*b* with the landing nipple dedicated grooves integral to the well wall, for example with the completion tubing of the same.

The hollow tubular element 8*b* is connected to elastic retaining means 6*b*, 7*b*, which elastic means are configured to operate the means of interference 9*b*.

In particular, the plurality of openings 90*b* of the tubular element 8*b*, in the locking conditions is configured to be positioned in correspondence with respective seats 90*c* of the well's wall—shown in FIGS. 1 and 2—and the interference means 9*b* are movable, in order to reach a clutch position in which occupy the seats 90*c* of the wall of the well, when they are actuated by the elastic retaining means 6*b*, 7*b*.

As shown in FIGS. 5 and 6, the tubular hollow element 8*b* can be made in several sections, coupled together through threaded connections provided with suitable restraint systems.

Preferably, the interference means 9*b* are locking dogs and are movable along a radial direction of the hollow tubular element 8*b*.

The hollow tubular element 8*b* is preferably cylindrical and the locking dogs 9*b* mechanically mates with the well seats 90*c*, by inserting themselves with a portion in order to block an axial sliding of the hollow tubular element 8*b* and of the valve 1*a* connected to it.

The locking dogs 9*b* in resting position, or as in unlock position of the locking system, are free to move. In particular, in retracted position, or as not inserted in the well seats 90*c*, the largest diameter of their circumference cannot be greater than the outside diameter of the tubular element 8*b* of the locking mechanism 1*b*.

The containment in the tubular element 8*b* of the locking rods 9*b* is obtained by means of dovetail joint appropriately modeled. The tubular element 8*b* of the locking mechanism 1*b* can be coupled to a locking tool 2*b* by means of an ACME threaded connection locked with a retaining system, and which will be described later.

Inside the cylinder 8*b* of the locking system may be contained the expansion and retaining sleeve 6*b* and the dogs 9*b*, which has the task of moving the locking dogs and keeping them expanded in the well seats 90*c* after anchoring the locking mechanism 1*b* in the well.

Preferably, the sleeve 6*b* is barded onto the cylinder 8*b* by means of shear pins 5*b* with the dogs 9*b* in retracted position.

Moreover, between the cylinder 8*b* and the sleeve 6*b* there is contained a spring 7*b* which, interacting between two shoulders, ensures the position of the sleeve 6*b* to keep the dogs 9*b* expanded in the seats 90*c* after the shearing of the pins 5*b*.

The upper portion of the sleeve 6*b* is provided with a J slot groove 14*b* to allow quick connection/disconnection with the J pin running tool 2*b* for the safety valve.

In correspondence of the groove 14*b* holes may be executed for insertion of shear pins 5*b* onto the installation tool 2*b* of the valve 1*a*.

The cylinder 8*b* can be connected above the body 4*b* of the locking tool 2*b* by means of an ACME threaded connection blocked by an appropriate retaining system.

Inside the body 4*b* of the lock mandrel 2*b* is contained the upper portion of the sleeve 6*b*, while in a lower portion of the body 4*b* there is a shoulder 40*b* to stop the sleeve 6*b* once sheared the pins 5*b* located between the running tool 2*b* and the sleeve 6*b*.

The body 4*b* of the locking mechanism 2*b* is coupled superiorly, by means of an ACME threaded connection locked with a restraint system, to a further tubular element 3*b*, provided of a shoulder 30*b* suitable for allowing an upward hold of the sleeve 6*b*.

The body 4*b* of the locking tool 2*b* and the further tubular element 3*b* may contain the running tool 2*b* of the safety valve 1*a*.

The running tool 2*b* may have J pins configured to engage the expansion sleeve 6*b* of the dogs 9*b*.

Preferably, the connection between the running tool 2*b* and the sleeve 6*b* takes place by inserting radial cylindrical J pins into the groove of the J slot fitting.

The running tool 2*b* of the locking system 1*b* is inferiorly connected to a pumping rod 15 by means of an API thread for standard rods and with the appropriately modified outer diameter.

In fact, to avoid interference inside the valve 1*a*, said rod 15, after having anchored the valve and released the running tool, works inside the valve and allows the movement transmission to the well bottom pump.

The running tool 2*b* is superiorly connected to a pony rod 16 for moving and inserting the valve assembly and locking systems in to the rod string.

For the sake of clarity, the procedure for the assembly and installation in the well of the valve 1*a* and of the locking system 1*b* will be described here after.

The safety valve and its locking mechanism are pre-assembled on a rod in the workshop, preferably of about 9 m of length, with an upper connection portion suitably modified for the passage without interference through the safety valve 1*a*.

The make up on the rods string takes place by bringing the assembly upright in correspondence with the center of the well, making up the male of the lower connection of the sucker rod onto the one already in the well connected to the bottom piston.

Before inserting the assembly in the rods string, a run was performed to the anchoring seat with an appropriate shape similar to the valve 1*a* dimension and all the spacing calculations necessary for correct positioning in the string were made.

Once the safety valve and its relative locking tool have been made up into the rod string, the run in hole into the well continues, assembling the calibrated rod when it is close to the anchoring seat of the valve 1*a*.

Before entering the valve 1*a* seat it is advisable to carry out tests to define the pickup and run in hole weights. Pump hydraulic fluid into the control line and fill flush all its volume.

Then the run in hole is continued slowly observing the weight of the string when approaching the valve seat.

A weight reduction of the order of 300-400 kg is indicative of the fact that the package of the lower seal 5*a* of the valve 1*a* has engaged the sealing section of the valve seat in the tubing in the well.

Continue the descent for about 30 cm. Once the sealing package 11*b* of the locking system 1*b* enters in the respective seat, the weight loss can reach 600-750 kg.

A change of behavior with a sudden decrease in weight indicates the arrival on the shoulder of the seat.

At this point the valve 1*a* is positioned correctly in the seat. Subsequently the control line can be pressurized to confirm that the valve 1*a* is in place and in its correct operation mode.

The safety valve is landed into its seat and in the open position, the sealing pads are in their rest position, and then the locking operation can be carried out.

As shown in FIG. 6, to anchor the valve, it is necessary to continue to slack off the weight on the shoulder of the anchoring system 1*b* of the valve 1*a*, until the pins 5*b* between the running tool 2*b* and the sleeve 6*b*, are severed and pins 5*b* between the sleeve 6*b* and the cylinder 8*b* of the locking system 1*b*.

Above the ground on the wellhead it is therefore possible to observe a "leap" of the rods string, indicating that the pins 5*b* have been sheared.

The expansion sleeve 6*b* is pushed towards the bottom of the well, the dogs 9*b* are in the expanding position and the spring 7*b* in extended position to ensure the position of the sleeve 6*b*.

Also the running tool 2*b* is pushed towards the bottom of the well and the cylindrical j pins are aligned with the vertical of the J slot sleeve grooves.

In order to disengage the running tool 2*b* from the locking system to allow the lifting of the rods string, it is necessary to keep the control line under pressure, and apply a slight torque on the rod 16.

Then lift the rod 16, taking the weight of the rods string, observing that the control line remains under pressure. Mark and note the position of the weight neutral point, this will be the reference point for the lower dead center, which will be 50 cm higher.

Continue lifting the rod string of about 7-7.5 m, until a sudden weight increase is observed.

This indicates that the lower connection of the sucker rod working inside the valve 1*a* has reached and has engaged the bottom of the valve.

Applying to the rod string an over pull to the whole string weight plus the friction of the valve seals, there will be confirmation that the valve is well anchored in its seat in the well.

Observe the pressure on the control line while checking the correct anchorage of the valve.

Return to the neutral point of the weight, mark the rod 16 and note the measurement, this will be the reference point for the upper dead center which must be 50 cm lower.

Complete the assembly of the equipment on the surface with the stuffing box, the cylinder and everything necessary to operate the pump.

Slowly start the unit making sure to set the lower and upper dead centers coherently with the spacing and the measurements detected.

Connect the control system to the control circuit and make sure that the intervention system logic provides the pump arrest when the pressure in the control line decreases or is lost.

After completing the adjustments and the operating tests of the pumping unit and the emergency stop system, continue pumping until the programmed production conditions are achieved.

Bleed off the pressure from the control line, check that the pump stops according to the scheduled times.

Bleed off the wellhead pressure and inflow test the well to check the safety valve sealing.

At the end of the safety valve leak off test, the control line of the safety valve 1*a* is pressurized again and fluid is pumped in the well to balance the pressure across the valve.

When the valve 1*a* there is the indication that the safety valve have been re-opened, the reciprocating pump can be restarted and the production resumed.

The present invention has been described with reference to its preferred embodiments. It is to be understood that each of the technical solutions implemented in the preferred embodiments, described here as a matter of example, may advantageously be combined differently to give rise to other embodiments, which belong to the same inventive core and all however falling within the protection scope of the claims set forth below.

The invention claimed is:

1. A downhole safety valve for an artificial lifting completion extraction well, said valve comprising:

a main body having an internally hollow portion and configured to allow a sliding movement of a rod therein, a sealing system connected to an inner wall of the main body, the sealing system comprising a plurality of reversible elastic elements arranged to surround said rod, an actuating device, including a piston, connected to the sealing system and configured to permit a movement of said reversible elastic elements, wherein the hollow portion of the main body is provided with a conical section region configured to cooperate with the sealing system so that the plurality of reversible elastic elements are movable between a first operating condition wherein a fluid flows through the valve in an outflow area defined between the sealing system and the rod, and a second operating position wherein each of the reversible elastic elements contacts the rod and occupies said outflow area preventing the passage of the fluid through the valve, and wherein each reversible elastic element of said plurality of reversible elastic elements comprises a free end provided with a sealing pad having an impact surface lying on a plane orthogonal to an extraction direction of the fluid, wherein said impact surface acts as a fluidic opposing element to a fluid advancement through the valve according to said extraction direction, and wherein the sealing system comprises a tubular collar coaxial to the main body and the outflow area is a circular crown, wherein the tubular collar is further provided with a portion segmented in eight of the plurality of reversible elastic elements.

2. The valve according to claim 1, wherein each of said sealing pads include a tapered section so as to slide along the conical section region of the main body and wherein, in said second operating position, each of said sealing pads contacts the rod and the conical section region in such a way that the outflow area of the valve is entirely occupied by the impact surface of each of said sealing pads.

3. The valve according to claim 1, wherein the actuating device is of a hydraulic type further comprises a chamber and a spring, wherein the main body is provided with an opening in communication with said chamber configured to allow a connection with the actuating device.

4. The valve according to claim 1, further comprising a locking system configured to be mechanically coupled to one end of the main body, said locking system configured to allow an anchoring of the valve inside the well and comprising:

a hollow tubular element coaxial to the main body and configured to allow the sliding of the rod internally, a plurality of openings formed in said hollow tubular element and adapted to house an interference component with the wall of the well, an elastic retaining element connected to the hollow tubular element and configured to actuate said interference component, wherein, when the locking system is inserted into the well, said plurality of openings are intended to be positioned in correspondence of respective seats of the wall of the well, and wherein said interference component is movable to an engaging position to occupy said seats when actuated by the elastic retaining element, so as to impede an axial sliding movement of the valve.

5. The valve according to claim 4, wherein said interference component is comprised of locking dogs that are movable along a radial direction of the hollow tubular element.

6. The valve according to claim 4, wherein the elastic retaining element comprises an expansion sleeve and a spring adapted to cooperate with each other so that actuation of the elastic retaining element corresponds to an expansion of the spring which pushes the sleeve towards the interference component to maintain the latter in said engaging position.

7. The valve according to claim 6, wherein the locking system further comprises a running tool of the valve, wherein an upper portion of the sleeve is provided with a groove to allow a connection with the running tool of the locking system, said running tool being removable from the sleeve once the valve is positioned in the well and the interference component is in the engaging position.

8. The valve according to claim 7, wherein the locking system further comprises a plurality of shear pins configured to retain a disengaged position the locking system, wherein said shear pins pass through the running tool and the expansion sleeve, and the hollow tubular element, and wherein the expansion sleeve and the running tool are relatively movable so as to shear the pins to move the locking system to said engaging position.

9. The valve according to claim 1, wherein the valve is a plug-type valve or an integrated-type valve.

* * * * *